United States Patent [19]

Killough

[11] 4,253,275

[45] Mar. 3, 1981

[54] GATE HINGE AND LUBRICATING MEANS THEREFOR

[76] Inventor: Jack D. Killough, Rte. 2, Box 121K, Cordova, Ala. 35550

[21] Appl. No.: 55,323

[22] Filed: Jul. 6, 1979

[51] Int. Cl.[3] ..... E05D 7/06; E05F 1/04

[52] U.S. Cl. ..... 49/239; 16/154

[58] Field of Search ..... 49/239, 236, 237, 238; 16/153, 154, 161

[56] References Cited

U.S. PATENT DOCUMENTS

| | | | |
|---|---|---|---|
| Re. 24,059 | 9/1955 | Pinion et al. | 49/239 X |
| 1,218,715 | 3/1917 | Sundh | 49/238 |

*Primary Examiner*—Kenneth Downey

*Attorney, Agent, or Firm*—Woodford R. Thompson, Jr.

[57] ABSTRACT

A gate hinge embodies an upstanding casing closed at its lower end and attached to a supporting post. A pintle is fixedly mounted within the casing and concentric therewith. Lower, upper and intermediate sleeves surround the pintle within the casing with the lower sleeve fixedly mounted at the lower end of the casing. The upper and intermediate sleeves are rotatable about the pintle with the upper sleeve being attachable to a gate. The sleeves are mounted in spaced relation to the outer surface of the pintle and the inner surface of the casing to define an annular lubricant receiving reservoir between the pintle and the inner surfaces of the sleeves and an annular lubricant receiving reservoir between the outer surfaces of the sleeves and the inner surface of the casing. Coacting cam surfaces on the sleeves urge the gate toward closed position upon rotation of the upper and intermediate sleeves.

2 Claims, 6 Drawing Figures

GATE HINGE AND LUBRICATING MEANS THEREFOR

BACKGROUND OF THE INVENTION

This invention relates to a gate hinge and lubricating means therefor and more particularly to a gravity closing hinge for a vertically movable gate which is mounted to swing in a generally horizontal plane.

Heretofore in the art to which my invention relates, difficulties have been encountered in providing a trouble-free, gravity actuated gate hinge due to the fact that it is very difficult to lubricate all surfaces of the various components of the hinge. For example, in U.S. Pat. No. Re. 24,059, wherein I was a co-inventor, the various elements of the hinge rotated about a vertical post with a close fit whereby the only way the elements could be lubricated would be to actually apply lubricant to the outer, exposed surface of the various components of the hinge. Since the lubricant was exposed to the elements, such as rain, the lubricant was readily washed away and had to be replaced periodically. Also, since the lubricant was applied to the outer surface of the components of the hinge, the lubricant was exposed to grit, dust and the like which not only prevented satisfactory operation of the gate hinge, but also brought about excessive wear between the moving parts of the hinge.

While the Sundh U.S. Pat. No. 1,180,336 discloses a gravity hinge having lubricating means at one side of the cooperating cam elements of the hinge, the other side of the cam elements are in close contact with the stationary member adjacent thereto. Accordingly, lubricant is applied to an area adjacent only one side of the cam elements of the hinge.

SUMMARY OF THE INVENTION

In accordance with my present invention, I provide a gate hinge which embodies an upstanding casing closed at one end and attached to a supporting post. A pintle is mounted concentrically within the casing. Mounted about the pintle and in spaced relation thereto are lower, upper and intermediate sleeves with the lower sleeve being fixedly mounted at the lower end of the casing and the upper and intermediate sleeves being rotatable about the pintle with the upper sleeve being attachable to the gate. Accordingly, the sleeves are mounted in spaced relation to the outer surface of the pintle and the inner surface of the casing to define annular lubricant receiving reservoirs along both the inner and outer surfaces of the sleeves. Coacting cam surfaces on the sleeves urge the gate toward closed position after the upper or intermediate sleeves have been rotated relative to the lower sleeve.

An object of my present invention is to provide improved and permanent means for maintaining an annular column of lubricant adjacent both the inner and outer surfaces of sleeve members having cam surfaces thereon which urge the gate toward closed position upon relative rotation of the sleeve members, whereby a supply of lubricant is provided at both sides of each sleeve member and at the same time the lubricant is protected from being contaminated by foreign elements, such as dust, grit and the like.

DESCRIPTION OF THE DRAWINGS

A gate hinge embodying features of my invention is illustrated in the accompanying drawings, forming a part of this application, in which.

DETAILED DESCRIPTION

Figure 1:
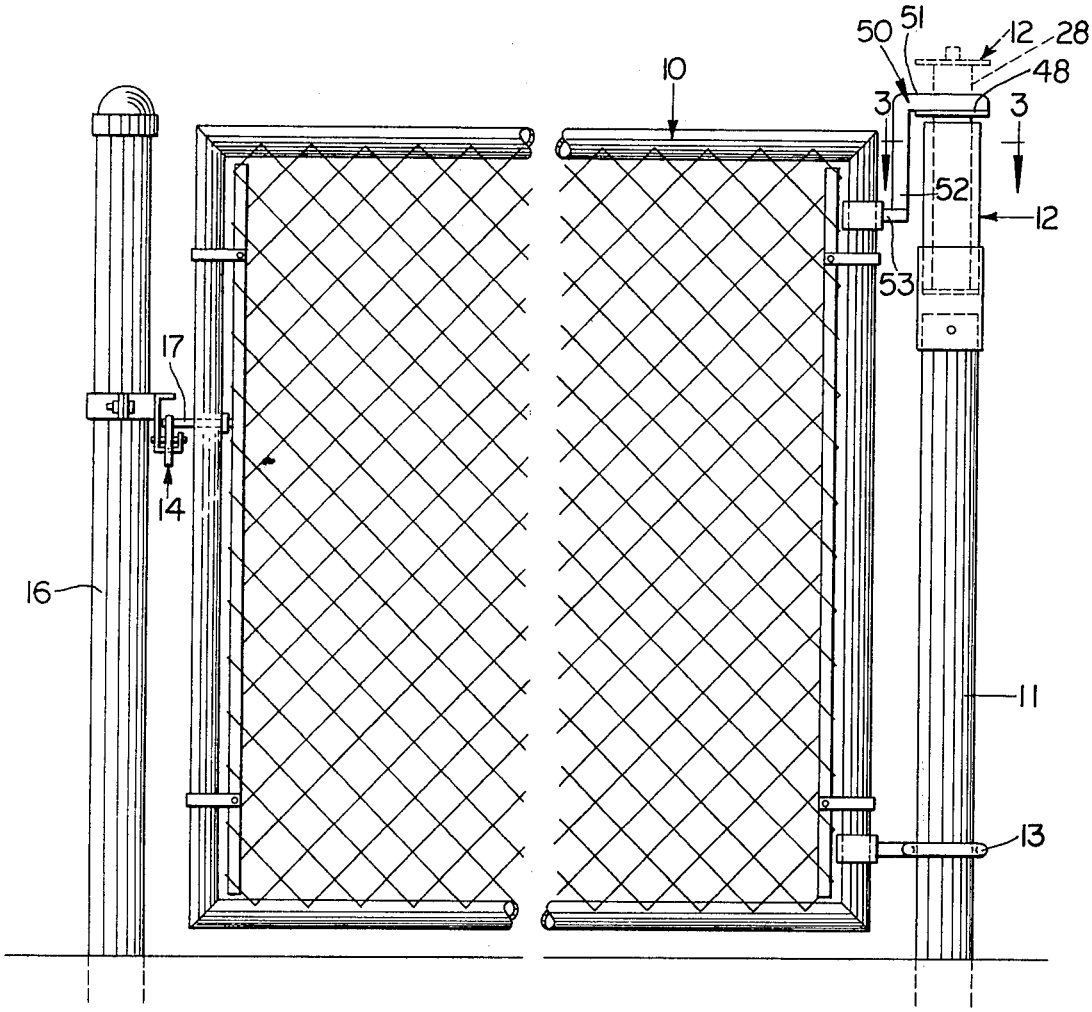
FIG. 1 is a side elevational view, partly broken away, showing my improved hinge assembly associated therewith.

Referring now to the drawings for a better understanding of my invention, I show a conventional type gate 10 which is supported at one side by a vertical post 11 having my improved hinge assembly, indicated generally at 12. The lower portion of the gate 10 carries a conventional type hinge element in the form of a ring-like element 13 which surrounds the post 11 and is adapted to slide upwardly and downwardly as the gate is opened and closed. A suitable latch assembly 14 is carried by a post 16 adjacent the swinging end of the gate 10 in position to receive a latch pin 17 carried by the gate 10, as shown in FIG. 1. Such a latch assembly is shown in my U.S. Pat. No. 2,996,328.

My improved hinge assembly 12 comprises an upstanding cylindrical casing 18 having its lower end telescoping into the upper end of the cylindrical post 11 and secured rigidly thereto by suitable means, such as by welding at 19. The lower end of the casing 18 is closed by a transverse closure member 21 which is secured to the lower end of the casing 18 by suitable means so as to provide a fluid-tight joint between the casing 18 and the closure member 21. The lower end of an upstanding pintle 22 is secured rigidly to the closure member 21, as shown in FIG. 4, whereby it extends concentric with the inner surface 23 of the casing 18.

Figure 5:
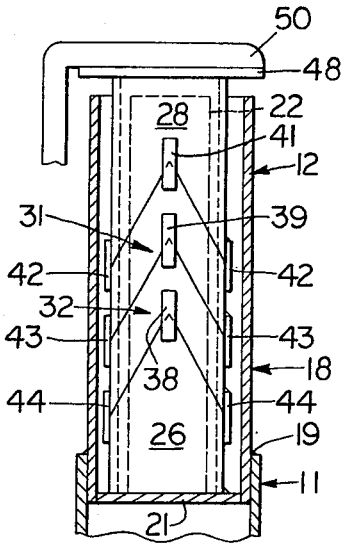
FIG. 5 is a sectional view similar to FIG. 4, drawn to a smaller scale, and showing the lower, upper and intermediate sleeves in elevation and in the position assumed while the gate is closed.
Figure 4:
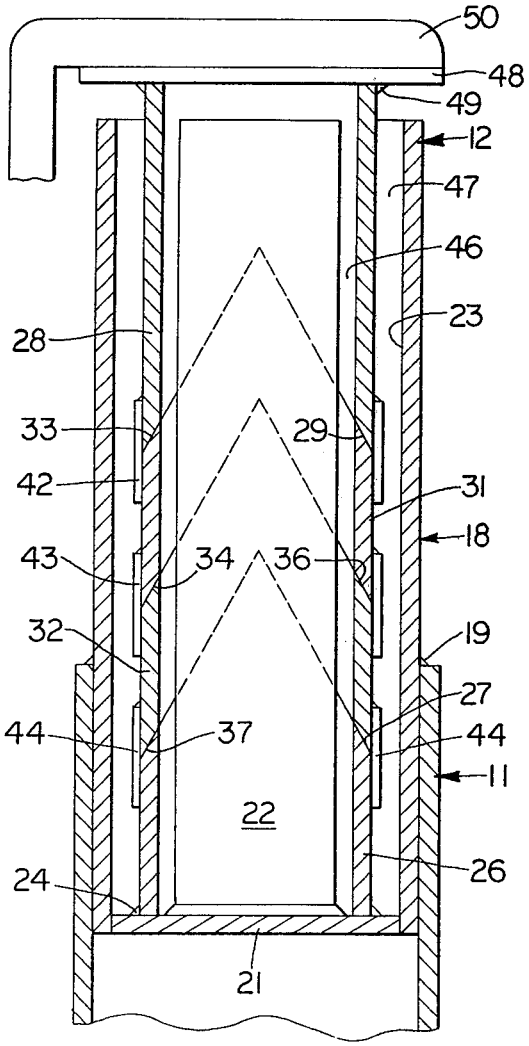
FIG. 4 is a sectional view taken generally along the line 4—4 of FIG. 3 showing the gate in closed position.
Figure 6:
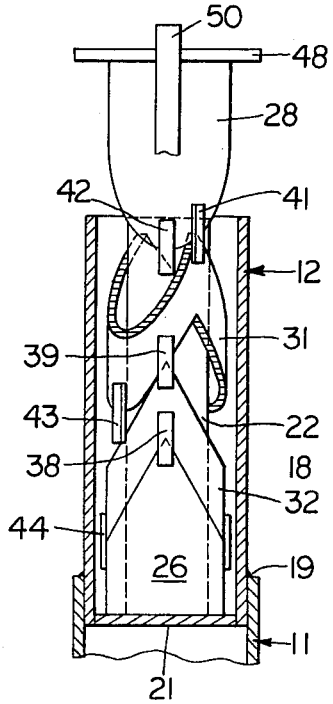
FIG. 6 is a sectional view similar to FIG. 5 showing the gate opened approximately 90° from the closed position shown in FIG. 5.

Surrounding the lower end of the pintle 22 and fixedly secured to the closure member 21 by welding at 24 is a lower sleeve 26 having an upper cam surface 27 which is of an inverted V-shape, as shown in FIGS. 4–6. The lower sleeve 26 is spaced from the outer surface of the pintle 22 and the inner surface 23 of the casing 18, as shown. Surrounding the pintle 22 at an elevation above the lower sleeve 26 is an upper sleeve 28 which is provided with a lower cam surface 29 which is also of an inverted V-shape. Surrounding the pintle 22 between the sleeves 26 and 28 are intermediate sleeves 31 and 32. The sleeve 31 is provided with an upper cam surface 33 and a lower cam surface 34, each of which is of an inverted V-shape, as shown. In like manner, the sleeve 32 is provided with an upper cam surface 36 and a lower cam surface 37, each of which is of an inverted V-shape.

Figure 2:
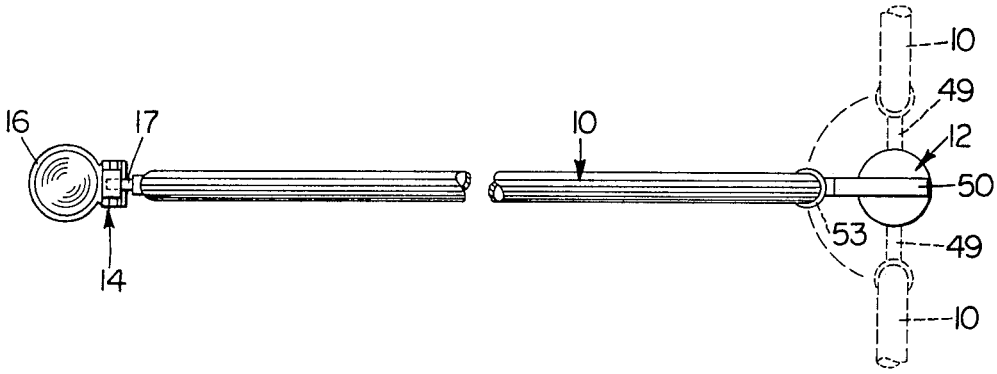
FIG. 2 is a top plan view of the gate assembly shown in FIG. 1 and showing other positions of the gate in dotted lines.

As shown in FIG. 4, the lower sleeve 26, the upper sleeve 28 and the intermediate sleeves 31 and 32 are in vertical alignment with each other to provide coacting engageable cam surfaces on adjacent ends of the sleeves which are adapted to urge the gate 10 toward closed position, as shown in solid lines in FIG. 2, upon rotation of the sleeve 28 and the intermediate sleeves 31 and 32 relative to the lower fixed sleeve 26. That is, the coacting, engageable cam surfaces operate in a manner similar to that disclosed in U.S. Pat. No. Re. 24,059, mentioned above. As shown in FIG. 5, the upper portion of the sleeves 26, 32 and 31 carry vertically extending lugs 38, 39 and 41, respectively. In like manner, the lower portions of the sleeves 28, 31 and 32 carry depending lugs 42, 43 and 44, as shown in FIGS. 4 and 5. The lugs carried by the sleeves not only aid in holding the sleeves in vertical alignment with each other and concentric with the inner surface of the casing 18 but are adapted to cooperate with each other whereby upon rotation of the upper sleeve 28 90° from the closed position shown in FIGS. 4 and 5, the lug 42 engages the lug 41 as the upper sleeve 28 moves to the raised position shown in solid lines in FIG. 6 and in dotted lines in FIG. 1. Upon engagement of the lug 42 with the lug 41, rotary motion is then imparted to the intermediate sleeve 31 until the lug 43 carried by the sleeve 31 engages the lug 39 carried by the sleeve 32 whereupon rotary motion is then imparted to the intermediate sleeve 32 until the lug 44 engages the upstanding lug 38 carried by the lower fixed sleeve 26. That is, the sleeves and their cooperating lugs operate in a manner similar to that disclosed in U.S. Pat. No. Re. 24,059.

Figure 3:
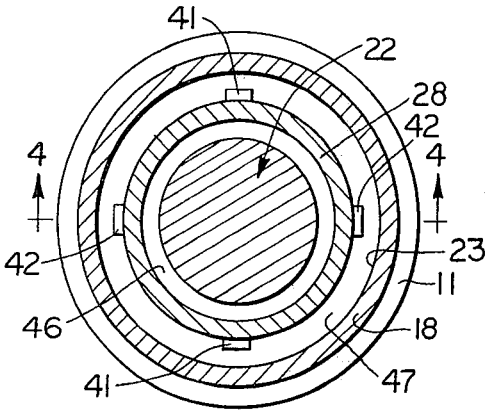
FIG. 3 is an enlarged, sectional view taken generally along the line 3—3 of FIG. 1.

As clearly shown in FIGS. 3 and 4, the upper sleeve 28 and the intermediate sleeves 31 and 32 are also mounted in spaced relation to the outer surface of the pintle 22 and the inner surface of the cylindrical casing 18 to define an annular lubricant receiving reservoir 46 between the pintle 22 and the inner surface of the sleeves 26, 28, 31 and 32 and an annular lubricant receiving reservoir 47 between the outer surfaces of the sleeves 26, 28, 31 and 32 and the inner surface 23 of the cylindrical casing 18 so as to provide a lubricant receiving reservoir at both sides of the sleeves.

The upper end of the upper sleeve 28 is secured rigidly to a cover plate 48, such as by welding at 49 to provide a cover for the upper end of the lubricant receiving reservoirs 46 and 47. Secured rigidly to the cover plate 48 is a gate support bracket 50 having a horizontally extending portion 51 secured to the cover plate 48 and a depending vertically extending portion 52 which is secured rigidly to a suitable clamp element 53 for fixedly securing the bracket 50 to the gate 10, as shown in FIG. 1.

From the foregoing, it will be seen that while the gate 10 is in the closed position, as shown in FIGS. 1–5, the cooperating cam surfaces of the sleeve members 26, 28, 31 and 32 are in full contact with each other. However, when the gate is moved toward open position in either direction, the lower cam surface 29 on the upper sleeve 28 moves relative to the upper cam surface 33 carried by the intermediate sleeve 31 whereby the upper sleeve 28 is raised as the upper sleeve 28 rotates relative to the intermediate sleeve 31. Accordingly, the gate 10 is raised toward the dotted line position shown in FIG. 1 and the solid line position shown in FIG. 6 upon opening the gate 10. If it is desired to open the gate more than 90°, continued rotation of the upper sleeve 28 causes the lugs 42 and 41 to engage each other and thus impart rotation to the intermediate sleeve 31 until the lug 43 thereon engages the lug 39 carried by the intermediate sleeve 32.

It will be apparent that if the gate 10 is only to be opened 90° from the closed position, only one intermediate sleeve 31 or 32, as the case may be, would be sufficient.

From the foregoing, it will be seen that I have devised an improved gate hinge and lubricating means therefor. By providing an annular lubricant receiving reservoir 46 between the outer surface of the pintle 22 and the inner surfaces of the sleeves 26, 38, 31 and 32, and an annular lubricant receiving reservoir 47 between the outer surfaces of the sleeves and the inner surface 23 of the cylindrical casing 32, continuous, annular columns of lubricant are provided at both the inner and outer surfaces of the sleeves, whereby all surfaces of the sleeves are in constant contact with a reservoir of lubricant.

While I have shown my invention in but one form, it will be obvious to those skilled in the art that it is not so limited, but is susceptible of various changes and modifications without departing from the spirit thereof.

What I claim is:

1. In a supporting and gravity closing hinge for a vertically movable gate mounted to swing in a generally horizontal plane, (a) an upstanding cylindrical casing adapted to be attached to a supporting post, (b) closure means closing the lower end of said cylindrical casing, (c) an upstanding pintle fixedly mounted within said cylindrical casing and concentric therewith, (d) a lower sleeve surrounding said pintle and fixedly mounted adjacent the lower end of said casing, (e) an upper sleeve rotatable about said pintle and adapted to be attached to the gate, (f) at least one intermediate sleeve rotatable about said pintle between said upper and lower sleeve, (g) said lower, upper and intermediate sleeves being mounted in spaced relation to the outer surface of said pintle and the inner surface of said cylindrical casing to define an annular lubricant receiving reservoir between said pintle and the inner surfaces of said sleeves and an annular lubricant receiving reservoir between the outer surfaces of said sleeves and said inner surface of said cylindrical casing so that a continuous annular column of lubricant is provided at both sides of said sleeves, and (h) coacting engageable cam surfaces on adjacent ends of said lower, upper and intermediate sleeves urging the gate toward closed position upon rotation of the upper and intermediate sleeves.

2. A hinge as defined in claim 1 in which said supporting post is a cylindrical member and the lower end of said cylindrical casing telescopes into the upper end of said cylindrical member and is secured rigidly thereto.

* * * * *